United States Patent [19]

Schmidt et al.

[11] 4,306,578

[45] Dec. 22, 1981

[54] TOBACCO SHEET REINFORCED WITH HARDWOOD PULP

[75] Inventors: Otto K. Schmidt, South Windsor, Conn.; William H. Hoge, Flemington, N.J.

[73] Assignee: AMF Incorporated, White Plains, N.Y.

[21] Appl. No.: 172,614

[22] Filed: Jul. 28, 1980

Related U.S. Application Data

[63] Continuation-in-part of Ser. No. 18,814, Mar. 8, 1979, abandoned.

[30] Foreign Application Priority Data

Mar. 17, 1978 [GB] United Kingdom ..... 10583/78

[51] Int. Cl.[3] ..... A24B 3/14

[52] U.S. Cl. ..... 131/353; 131/355; 131/357; 131/374

[58] Field of Search ..... 131/353–359, 131/370–375, 331

[56] References Cited

U.S. PATENT DOCUMENTS

| | | | |
|---|---|---|---|
| 328,300 | 12/1885 | De Susin | 131/358 |
| 611,107 | 12/1898 | Dillon | 131/358 |
| 872,987 | 12/1907 | Capehart | 131/358 |
| 888,743 | 5/1908 | Rodgers | 131/356 |
| 1,998,758 | 12/1935 | Holt et al. | 162/10 |
| 2,576,021 | 11/1951 | Koree | 131/359 |
| 2,959,478 | 2/1961 | Hottling et al. | 131/358 |
| 3,125,098 | 3/1964 | Osborne | 131/355 |
| 3,213,858 | 10/1965 | Merritt et al. | 131/372 |
| 3,255,760 | 6/1966 | Selke | 131/331 |
| 3,499,459 | 3/1970 | Townend | 131/358 |
| 3,703,177 | 11/1972 | Hind et al. | 131/359 |
| 3,820,548 | 6/1974 | Buchmann et al. | 131/369 |
| 3,872,870 | 3/1975 | Buchmann et al. | 131/370 |
| 4,144,894 | 3/1979 | Schmidt et al. | 131/355 |

*Primary Examiner*—V. Millin

*Attorney, Agent, or Firm*—George W. Price; Michael Zall

[57] ABSTRACT

Tobacco sheet is prepared from high solids aqueous slurries incorporating a reinforcing agent constituted by unrefined short cellulose fiber, having an average length of less than 2.0 mm.

12 Claims, No Drawings

TOBACCO SHEET REINFORCED WITH HARDWOOD PULP

This application is a continuation-in-part of U.S. Application, Ser. No. 018,814 now abandoned, filed Mar. 8, 1979, and relates to tobacco sheet, compositions for forming same and processes for preparing and using high solids compositions castable into tobacco sheet of high tensile strength at low cost.

BACKGROUND OF THE INVENTION

Numerous reconstituted tobacco compositions and processes for their manufacture are known, in which tobacco particles are formed into a coherent integral structure such as a rod or sheet which is thereafter used as binder or wrapper in cigars or as filler in cigarettes or cigars. The reconstituted structures desirably also exhibit strength and selective surface properties for aesthetics and handling, as well as required flexural properties for processing through tobacco machinery, rendering formulation a critical aspect of manufacturing operations.

Conventional methods for the preparation of tobacco sheet from comminuted tobacco employ a relatively low viscosity low consistency aqueous slurry of tobacco and an adhesive which is cast on a supporting surface and dried. Conventionally, these slurries remain castable only up to about 9–11% solids. Such methods are naturally energy intensive with regard to the necessity of removing relatively large quantities of water. The low-solids slurrying technique has been deemed necessary, however, because of the difficulty in wetting and uniformly dispersing tobacco at high solids, and the unavailability of readily dispersible agents effective as adhesives and handleable at high solids levels.

Improvements have been made in these arts to provide high solids processable slurries, as described in copending and commonly assigned U.S. Pat. No. 4,144,894 to Schmidt, et al and incorporated herein by reference; and improved mixing techniques at high solids levels, as described in copending and commonly assigned U.S. application Ser. No. 001,249 of Schmidt filed Jan. 5, 1979 also incorporated herein by reference.

Thus, high solids slurries may now be employed to reduce the energy considerations in such processes, but further improvements have been sought. One objective in the preparation of any reconstituted tobacco sheet is adequate strength i.e., tensile and tear properties should be sufficient to prevent cracking, crumbling, tearing or stretching in processing and handling.

Tobacco sheet of enhanced tensile strength has been reported in U.S. Pat. Nos. 2,897,103; 3,097,653; or 3,115,882 to be obtainable by careful control over tobacco particle size in dry or wet grinding. As tobacco constitutes at least 75 percent by weight of the sheet, it is more desirable and less energy intensive to control tensile strength by other means.

Certain tensile and tear properties are afforded by ensuring adequate cohesiveness and flexibility in the sheet, as by the selection of appropriate adhesive agents. Generally, however, adhesives alone have not been able to supply the full measure of strength, tear resistance and resistance to disintegration under the range of tobacco processing conditions to which the reconstituted tobacco sheets are subjected. For example, in cigarette sheet applications, fiberless formulations generally have impaired shreddability resulting in more breakup during shredding and shorter shreds. This, in turn, adversely affects the filling power of these shreds (i.e., the firmness contributed to cigarettes by a unit weight of these shreds).

Accordingly, refined softwood cellulosic fiber has been employed to reinforce the adhesive system in the reconstituted tobacco sheet, thus increasing the tensile strength, flexural strength and resistance to disintegration. Softwood cellulosic pulps in the unrefined or lightly refined condition have cellulosic fibers which are relatively long and free to interengage and entangle, causing agglomerations which result in slits and other difficulties during the process of casting thin films from reconstituted tobacco slurries. In addition, long fibers tend to orient in the machine direction during casting, providing a large difference in strength characteristics in the longitudinal and transverse directions (i.e., a large orientation factor), which is undesirable in some applications. The further refining of softwood cellulosic pulp can reduce the fiber length to a point where it does not interfere with the casting of thin films. However, the mechanical work input during the refining operation fibrillates the cellulosic fibers into a branching network of smaller and smaller fibrils, which results in an interlocking network in the final tobacco sheet. This network of fibers and fibrils is largely responsible for improved physical properties in the reconstituted tobacco sheets, but an undesirable consequence of the refining operation on softwood pulp is the increase in viscosity of the fibrous mass as the pulp becomes more fibrillated and hydrated. When such pulps are added to reconstituted tobacco slurries they result in substantial increases in viscosity. This, in turn, necessitates slurry preparation at lower solids so that the mass is still formable into thin films, resulting in increased drying costs to remove the extra water added. In addition to the increased viscosity and higher drying costs associated with refined softwood pulps, capital costs in the plant are increased due to the requirements for a paper refining system, and labor and utility costs are increased for the pulp refining operation and the energy costs associated therewith. U.S. Pat. Nos. 3,125,098 and 3,464,422 describe the preparation and use of very highly refined pulps in tobacco sheet manufacture to enhance tensile strength and to reduce orientation factors associated with more coarsely refined pulp. However, although the products obtained are superior, the high degree of refining produces pulps with even higher viscosities which must be processed at even lower solids (i.e., with increased drying costs). The longer refining cycle for such pulps increases the energy input required for refining and its labor content.

Accordingly, it is an object to provide reinforcement to reconstituted tobacco sheets.

It is also an object to employ a fibrous reinforcing agent which is compatible with the casting system in use.

In addition, it is an object to provide such fibrous reinforcement without substantially increasing the viscosity of the tobacco slurry.

Further, it is an object to provide fibrous reinforcement which is compatible with high solids castable tobacco compositions.

It is another object to prepare tobacco sheet products with adequate physical properties at minimum capital and operating expense.

These and other objects are achieved in the practice of the present invention as set forth in the following description.

BRIEF DESCRIPTION OF THE INVENTION

It has now been found that unrefined short fiber pulp such as hardwood pulp may be employed to effectively reinforce tobacco sheets when incorporated in high solids castable compositions at relatively low levels. The resulting process eliminates the requirement for costly paper refining equipment and the costly labor and energy involved in pulp refining. Unrefined short fiber pulp is lower in apparent viscosity characteristics than softwood pulp refined to the same fiber length; accordingly, the unrefined short fiber formulation can be handled at higher solids. This results in less water to evaporate, and a process which is more economical and efficient.

Thus, delignified wood pulps predominating in hardwood species such as oak, gum or poplar, may be employed at levels of as little as 2–12 percent by weight without refining in combination with 75 percent or more by weight tobacco and an effective amount of an adhesive agent, at formulation solids levels of 10 to 40 percent or more to economically and efficiently prepare tobacco sheet of commercial quality.

Without wishing to be bound by an essentially hypothetical elucidation, it is believed that the dimensions of the unrefined hardwood pulp in combination with the viscosity characteristics of the high solids composition result in relatively restricted movement of the fibers in the high viscosity medium during casting and film formation. This results in a reduced tendency for fiber agglomeration and a reduced tendency for the fibers to orient preferentially in the longitudinal direction during casting. Accordingly, sheet formation is trouble-free and the tobacco sheet product has a reduced orientation factor, which is desirable for most applications.

DETAILED DESCRIPTION OF THE INVENTION

The fibers predominating in the pulp reinforcing agent of the present invention exhibit an average length of less than about 2 mm, preferably ranging from about 0.5 to about 1.5 mm, (essentially no fiber retained on a 14 mesh Clark Classifier screen) and a width of 5 to 30 microns and are commonly constituted essentially of hardwood species in which these fiber dimensions are typical. The pulps are delignified as by chemical pulping such that lignin, other non-cellulosic wood components, waste, etc. are essentially removed, and the fibers, which are then essentially cellulose of a high degree of purity, are then separable and dispersible in aqueous systems.

Suitable hardwood species include oak, gum and poplar conveniently processed into the form of bleached or unbleached pulps such as St. Croix Kraft (Georgia Pacific o.), Oxy-Brite (The Chesapeake Corporation of Virginia) and Acetakraft (International Paper Co.). One suitable southern hardwood pulp is comprised of 38% gum, and 30% oak in admixture with eight other hardwood species, and exhibits an average fiber length of 1.26 mm. and an average width of 21.9 microns. Another suitable pulp is about half gum and half oak, with an average fiber length of 1.37 mm. and an average width of 25.7 microns. Other short fiber pulps, such as unbleached and bleached bamboo, Esparto grass, bagasse, rice straw and wheat straw, may also be employed successfully where available, and in some respects may be preferred in selected embodiments.

The pulp reinforcing agent is employed in minor proportion sufficient to enhance tensile or tear properties in the sheet. Normally the pulp reinforcing agent comprises from about 2 to about 12% of the total dry weight of the tobacco sheet, or a proportionate amount of solids in the baseweb or formable composition.

The pulp is slurried, conveniently in process water, at a consistency of 2–4%, allowed to hydrate, i.e., over a period of fifteen minutes, and agitated vigorously to achieve fiber disengagement and separation. Other sheet ingredients, including an adhesive agent and optionally cross-linking agents, humectants, colorants, flavorants, antimycotic or antibacterial agents and the like, are added to form a baseweb for combination with the dry comminuted tobacco.

The baseweb is prepared to a solids content, or consistency of 4–6% depending on the targeted slurry solids and desired tobacco content, and is then combined with the tobacco to provide the formable composition for preparation of tobacco sheet in accordance with the invention.

Preferably, the formable composition of this invention is processed in the manner disclosed in the aforementioned U.S. Appln. Ser. No. 001,249 of Schmidt in that the dry tobacco and baseweb composition are rapidly intermixed in a high intensity mixer for a period less than that sufficient for the tobacco to equilibrate with available moisture from the aqueous phase. The pulp in the baseweb constituting 2–12% by weight of the whole, is not itself refined in this operation in the usual sense, although measurable work is imparted to the system in its brief passage through the mixing zone. Alternatively, the pulp may be employed in a more conventional manner in lower-solids tobacco slurries processed with more conventional mixing equipment. In such cases, it will still contribute savings through elimination of paper refining equipment, and labor energy savings associated with elimination of a pulp refining operation.

The tobacco employed in this operation is conventionally comminuted, for example to a dimension passing through an 80–100 mesh U.S. standard sieve. It may be constituted of Burley, Connecticut broadleaf, Virginia bright or other available varieties alone or in suitable admixture and may comprise a proportion of stems, stalks or recovered dust. The tobacco constitutes at least 75 percent and preferable 80–90 percent by weight of the finished sheet, or a proportionate amount of the formable composition.

The baseweb includes an adhesive agent which is soluble in or at least dispersible in water.

The adhesive agent or binder may constitute any of these conventionally used such as the film-forming polysaccharide adhesive gums such as locust beam gum, gum tragacanth, gum karaya, galactomannan gums (guar gum and the like), and their derivatives; the cellulose ethers and derivatives such as methyl cellulose, hydroxypropyl cellulose, hydroxypropyl cellulose, hydroxypropyl carboxylmethyl cellulose; polyuronides such as the pectins; algins and their derivatives, etc.

The amount and type of adhesive agent employed is related primarily to the sheet characteristics required, since it is a major structural ingredient of the sheet which must provide an integral, cohesive sheet when dried to a selected moisture condition, having sufficient strength and flexibility to permit doctoring from the casting surface and subsequent processing. It is preferred to minimize the amount of adhesive, in part to maximize the tobacco content and, generally it will be sufficient to employ no more than 5 to 12 percent by weight of the dried sheet components.

For preparation of high solids castable compositions, at the upper part of the useful range, i.e., 16 to 40 percent or more by weight of solids, it is preferred to employ tamarind gum as the adhesive, as described in aforesaid U.S. Pat. No. 4,144,894 to Schmidt, et al The formable composition, i.e., the combined tobacco and baseweb is pumped directly to the casting apparatus and then formed into sheet in conventional manner. Thus, thin sheet is cast, dried and collected in a standard manner for conversion into cigarette or cigar filler, or cigar wrapper or binder.

The preferred formable compositions at 16–40 percent solids can be extremely viscous. Further, the tobacco swells as it equilibrates with the aqueous phase taking up essentially all available water and rendering the system difficult or impossible to form by casting. Accordingly in the preferred embodiment, the formable composition at high solids level is essentially immediately cast, i.e., before the tobacco has reached its equilibrium state with the aqueous phase. Usually, a continuous stainless steel belt is employed as described in U.S. Pat. No. 2,769,734 incorporated herein by reference. The slurry film is then heated to dryness or to a selected moisture condition (e.g., 13 percent by weight) at a temperature of from about 80°-90° C. Following drying of tobacco sheet, it may be remoistened to a predetermined extent, for example to a moisture content in the range of from about 10 to 30 percent, depending on the end use of the sheet.

The cast sheet may be provided with a surface coating to control surface properties such as tackiness. A coating of cellulose ether such as ethyl cellulose is commonly employed as disclosed and claimed in U.S. Pat. No. 3,185,161 of Fiore et al.

Tobacco sheets prepared in accordance with this invention preferably exhibit properties conforming to those set forth in the following table.

TABLE I

| | |
|---|---|
| Sheet Wgt. | 6.5–7.5 g/ft$^2$ |
| Thickness | 5–7 mils |
| Breaking Strength, grams/inch width | |
| Longitudinal, dry (DL) | 1400–1900 g/in. |
| Longitudinal, wet (WL) | 150–250 g/in. |
| Transverse, dry (DT) | 650–900 g/in. |
| Transverse, wet (WT) | 90–130 g/in. |

The preferred tobacco sheet exhibits an orientation factor $$\frac{\text{(Longitudinal breaking strength)}}{\text{Transverse breaking strength}}$$

of less than 2.0 and wet breaking strength of no less tha 10% of the corresponding longitudinal and transverse dry breaking strengths. Breaking strengths are measured on a Scott Serigraph using one inch wide test specimens. The sheet is equilibrated under controlled humidity conditions to provide a constant humidity condition in the range of 12–16% depending upon tobacco types. Wet testing is accomplished by surface wetting the sheet about ¼ inch from one end.

Porosity of the sheets is determined utilizing a Gurley densometer at an air flow rate of 300 cc.

Viscosities are reported as solution viscosity, determined on a Brookfield viscometer utilizing spindle #1 or 4 at 20 rpm.

Filling power is measured on shredded sheet equilibrated or corrected to a moisture content of 12.5% utilizing a Borgwald densometer. The value, expressed as cc/g is the compressed or specific volume.

The term "tobacco" as used herein includes tobacco, reconstituted tobacco and tobacco waste such as stems or fines. Moreover tobacco substitutes such as cocoa leaves and other naturally occurring or cultivated vegetation, tobacco-like substances, and similarly structured synthetic compositions well known in the art e.g., cellulose or cellulose derivatives are also intended to be within the scope of the present invention.

The invention is further illustrated in connection with the following Examples in which all parts are be weight unless specified otherwise.

EXAMPLE I

Tobacco sheet was prepared by casting and drying a composition (aqueous slurry) comprising 85% tobacco and a baseweb composition comprising 4.2% slushed pulp, 9.0% tamarind gum, 1.05% guar gum, and 0.75% glyoxal cross-linking agent (proportions by weight, based upon the finished sheet), and evaluated for differing short fiber pulps (Clark Classification, %:14 mesh 0; 30 mesh 30–40; 50 mesh 30–40; 100 mesh 10–15; −100 mesh 20–30). Properties of the resulting sheet are set forth in Table II, as follows:

TABLE II

| Short Fiber Pulp | Rice Straw | Esparto | Bamboo | Bleached Bamboo | Wheat Straw |
|---|---|---|---|---|---|
| Sheet Wgt. g/ft$^2$ | 6.3 | 7.4 | 6.8 | 6.9 | 6.6 |
| Thickness, mil | 5.2 | 5.3 | 5.4 | 5.2 | 5.3 |
| Density, g/cc | 0.51 | 0.59 | 0.53 | 0.56 | 0.53 |
| Breaking Strength | | | | | |
| DL | — | — | — | 640 | — |
| DT | — | — | — | 526 | — |
| WL | 81 | 110 | 115 | 97 | 68 |
| WT | 50 | 80 | 80 | 84 | 42 |
| Orientation Factor, Wet | 1.62 | 1.38 | 1.44 | 1.15 | 1.62 |
| Dry | — | — | — | 1.22 | — |

EXAMPLE II

In the same manner as in Example I, a baseweb composition comprising 34% Oxibrite hardwood pulp, 24% Amatex 83 raw tamarind gum, 25% Amatex 83 coated tamarind gum, 7% guar gum, and 10% glyoxal cross-linker was combined with tobacco (Virginia bright scrap leaf) in an Eppenbach mixer in proportion to provide 85% and 80% tobacco, respectively, in the tobacco sheet, cast from an approximately 22% solids slurry. The sheets exhibited the characteristics set forth in Table III, as follows:

| | | |
|---|---|---|
| Tobacco (VBSL) | 85%, wgt. | 80%, wgt. |
| Hardwood Pulp | 5%, wgt. | 5%, wgt. |
| Sheet Wgt., g/ft$^2$ | 7.76 | 6.42 |
| Moisture % | 13.8 | 13.6 |
| Thickness, mil | 5.75 | 5.35 |
| Density, g/cc. | 0.56 | 0.50 |

-continued

| | | |
|---|---|---|
| Porosity, sec. | 20-32 | 11-13 |
| Breaking Strength, g/in. | | |
| DL | 1368 | 1150 |
| DT | 1020 | 725 |
| WL | 215 | 165 |
| WT | 105 | 88 |

EXAMPLE III

In this Example, a series of castable compositions were prepared, to provide varying levels of hardwood pulp (4-6%) and cross-linking agent (1.0-1.5%) in tobacco sheets cast therefrom under standard conditions, utilizing 85% Virginia bright scrap leaf tobacco.

The control baseweb composition, prepared to a solids level of 4.10% comprised 27% Oxibrite hardwood pulp, 28% raw tamarind gum, 28% cooked tamarind gum, 7% guar gum, and 10% glyoxal, and exhibited a pH of 6.6 and a viscosity of 2800 cps. (spindle #4). When combined with the tobacco in a high intensity mixer, a castable composition (slurry) was formed, and then cast into sheet, (slurry temperature of 86° F., viscosity of 34000 cps (spindle #1) pH=5.5, and a solids level of 20.5%).

In the remaining runs, the baseweb composition was adjusted for solids level and pulp content e.g., in the case of 5% pulp, to 34% Oxibrite pulp, 24% raw tamarind gum, and 25% cooked tamarind gum (viscosity 44000 cps (spindle #1); solids 22.8% at 86° F.) and in the case of 6% pulp, to 40% Oxibrite pulp (40000 cps (spindle #1), 20.5% solids at 86° F.) with added glyoxal as necessary.

Tobacco sheet properties are set forth in Table IV as follows:

TABLE IV

| | 1 | 2 | 3 | 4[1] | 5[1] |
|---|---|---|---|---|---|
| Hardwood Pulp, % | 4 | 5 | 5 | 6 | 6 |
| Cross-linker, Glyoxal, % | 10 | 10 | 15 | 10 | 15 |
| Sheet Wgt., g/ft$^2$ | 6.52-7.07 | 6.88-7.66 | 7.27-7.95 | 8.44-9.41 | 7.89-8.77 |
| Moisture %[2] | 9.2-10.8 | 8.8-12.8 | 12.4-20.2 | 9.0-12.5 | 10.4-11.5 |
| Thickness, mil[2] | 4.8-5.1 | 4.98-5.80 | 5.22-5.75 | 5.95-7.15 | 5.73-6.4 |
| Denisity, g/cc[2] | 0.57-0.58 | 0.56-0.57 | 0.57-0.59 | 0.54-0.60 | 0.56-0.58 |
| Porosity, sec. | 12-30 | 15-28 | 13 | 15-27 | 11-16 |
| Breaking Strength, g/in | | | | | |
| DL | 1400,1360 | 1300,1630 | 1200,1140 | 2000+,1500 | 1300,1200 |
| DT | 610,745 | 485,780 | 780,540 | 800,695 | 478,640 |
| WL | 155,180 | 160,185 | 183,200 | 193,190 | 210,195 |
| WT | 94,72 | 77,85 | 79,80 | 89,95 | 80,85 |
| Filling Power, cc/g | 4.2 | 4.08 | 4.06 | 4.00 | 4.03 |

[1]84/16 tobacco baseweb composition

[2]Expressed as the range of values taken at three transverse locations across the sheet.

EXAMPLE IV

In the same manner as Example III, 85% tobacco sheet was cast from a slurry of 50,000 cps (spindle #1 solids 21.6%, 104° F.) comprising all cooked tamarind gum 4% hardwood pulp and 1.5% glyoxal. Properties of the sheet are set forth in Table V, as follows:

TABLE V

| | |
|---|---|
| Sheet Wgt., g/ft$^2$ | 7.49-8.42 |
| Moisture, % | 14.2-15.3 |
| Thickness, mil | 5.37-5.85 |
| Density, g/cc | 0.57-0.61 |
| Porosity, sec. | 27-36 |
| Breaking Strength, g/in | |
| DL | 1800-1060 |
| DT | 895,615 |
| WL | 185,205 |
| WT | 90,105 |

EXAMPLE V

In the same manner as Example III tobacco sheet was prepared with pulp level varying from 3 to 5% (1.0% glyoxal) utilizing a constant 85% of tobacco constituted respectively by runs of 100% Virginia bright scrap leaf (VBSL) and a 65/35 blend of VBSL and Virginia bright cut stems. (VBCS).

Baseweb composition ranged (at 3% hardwood pulp) from 20% Oxibrite pulp, 28% raw tamarind gum, 35% cooked tamarind gum through (at 4% hardwood pulp) 27% Oxibrite pulp, 28% raw tamarind gum, 28% cooked tamarind gum to (at 5% hardwood pulp) 34% Oxibrite pulp, 24% raw tamarind gum, 25% cooked tamarind gum. Slurry solids ranged from 21.7 to 22.6%.

Properties of the cast sheet are set forth in Table VI, as follows:

TABLE VI

| Run | 1 | 2 | 3 | 4 | 5 | 6 |
|---|---|---|---|---|---|---|
| Tobacco | VBSL | VBSL/VBCS | VBSL | VBSL/VBCS | VBSL | VBSL/VBCS |
| Hardwood pulp, % | 3 | 3 | 4 | 4 | 5 | 5 |
| Sheet Wgt., g/ft$^2$ | 6.92-8.26 | 7.62-8.41 | 7.92-8.96 | 7.40-8.24 | 6.96-7.78 | 7.30-8.46 |
| Moisture, % | 16.1-17.8 | 10.2-11.0 | 11.0-13.6 | 8.6-9.6 | 8.3-8.9 | 10.7-11.9 |
| Thickness, mil | 5.23-6.64 | 6.0-6.94 | 5.98-6.7 | 6.21-6.71 | 5.60-6.02 | 5.53-6.65 |

TABLE VI-continued

| Run | 1 | 2 | 3 | 4 | 5 | 6 |
|---|---|---|---|---|---|---|
| Density, g/cc | 0.52-0.56 | 0.48-0.54 | 0.56-0.57 | 0.50-0.52 | 0.53-0.54 | 0.54-0.57 |
| Porosity, sec | 6 | 4-5 | 10-12 | 3-6 | 6-7 | 8-10 |
| Breaking Strength g/in. | | | | | | |
| DL | 1120 | 1493 | 1630 | 2000+ | 1180 | 1236 |
| DT | 845 | 825 | 922 | 1965 | 740 | 840 |
| WL | 144 | 137 | 157 | 162 | 140 | 132 |
| WT | 75 | 72 | 75 | 87 | 64 | 62 |
| Filling Power cc/g | 4.23 | 4.14 | 4.29 | 4.21 | 4.5 | 4.25 |

We claim:

1. A formable composition comprising comminuted tobacco or tobacco substitute, an adhesive agent therefor, and from about 2 to about 12 percent by weight (dry basis) of unrefined short cellulose fiber, said fiber having an average length of less than 2.0 mm effective to enhance tensile or tear properties in sheet formed therefrom said tobacco or tobacco substitute, adhesive agent, and cellulose fiber being dispersed in an aqueous slurry at a level of at least about 10 percent solids by weight wherein said cellulose fiber is selected from the group consisting of unrefined hardwood pulp, bagasse, bamboo, rice straw, wheat straw and Esparto grass.

2. The formable composition of claim 1 wherein said cellulose fiber is unrefined hardwood pulp.

3. The formable composition of claim 2, wherein said hardwood pulp is derived essentially from oak, gum and poplar woods.

4. A coherent integral tobacco or tobacco substitute sheet comprising tobacco or tobacco substitute, an adhesive and 2 to 12 percent by weight of delignified unrefined hardwood pulp comprising cellulose fibers having an average length of less than about 2.0 mm effective to enhance tensile or tear properties in the sheet.

5. The tobacco or tobacco substitute sheet or claim 4, wherein said adhesive comprises tamarind gum.

6. A method for improving the physical properties of reconstituted tobacco or tobacco substitute sheet comprising incorporating in said sheet from about 2 to 12% of delignified unrefined hardwood pulp comprising cellulose fiber having an average length of less than 2.0 mm effective to enhance tensile or tear properties in the sheet.

7. A method of preparing tobacco or tobacco substitute sheet comprising combining dry comminuted tobacco or tobacco substitute with a baseweb composition comprising an aqueous slurry consisting essentially of an adhesive for said tobacco or tobacco substitute and cellulose fiber having an average length of less than 2.0 mm effective to enhance tensile or tear properties in the sheet to form a castable composition having a solids content of at least 10 percent by weight, wherein said cellulose fiber is selected from the group consisting of unrefined hardwood pulp, bagasse, bamboo, rice straw, wheat straw and Esparto grass, casting said composition as a thin sheet, and drying.

8. The method of claim 7 wherein said adhesive comprises tamarind gum.

9. The method of claim 8 wherein the castable composition has a total solids content of at least 16% by weight.

10. The method of claim 9 wherein said cellulose fiber comprises a delignified unrefined hardwood pulp.

11. The method of claim 10, wherein said hardwood pulp is derived essentially from oak, gum and poplar woods.

12. The method of claim 7 wherein said tobacco or tobacco substitute and said baseweb composition is combined in a high intensity mixing zone and is cast into a film within a period less than that required to permit said tobacco to reach an equilibrium state with the water present.

* * * * *